United States Patent [19]

Batteux

[11] Patent Number: 4,965,543

[45] Date of Patent: Oct. 23, 1990

[54] MAGNETIC TRIP DEVICE WITH WIDE TRIPPING THRESHOLD SETTING RANGE

[75] Inventor: Pierre Batteux, Vizille, France

[73] Assignee: Merin Gerin, France

[21] Appl. No.: 430,367

[22] Filed: Nov. 2, 1989

[30] Foreign Application Priority Data

Nov. 16, 1988 [FR] France ..... 88 15198

[51] Int. Cl.[5] ..... H01H 9/00

[52] U.S. Cl. ..... 335/174; 335/176; 335/273

[58] Field of Search ..... 335/174, 175, 176, 259, 335/264, 265, 267, 273

[56] References Cited

U.S. PATENT DOCUMENTS 4,245,204 1/1981 Clausing et al. ..... 335/174
4,339,421 7/1982 MacLean ..... 335/174
4,370,637 1/1983 Siffroi ..... 335/174
4,710,739 12/1987 Heyne et al. ..... 335/174

FOREIGN PATENT DOCUMENTS 611701 4/1935 Fed. Rep. of Germany .
1513504 of 1970 Fed. Rep. of Germany .
2458874 2/1976 Fed. Rep. of Germany .

*Primary Examiner*—George Harris
*Attorney, Agent, or Firm*—Arnold, White & Durkee

[57] ABSTRACT

A magnetic trip device having two plunger cores cooperating respectively with polar parts of a fixed magnetic circuit excited by a coil. The effects of the plunger cores are opposing, and by adjusting the inital position of the moving core assembly constituted by these two plunger cores, the tripping thereshold can be adjusted with a large amplitude.

10 Claims, 4 Drawing Sheets

MAGNETIC TRIP DEVICE WITH WIDE TRIPPING THRESHOLD SETTING RANGE

BACKGROUND OF THE INVENTION

The invention relates to a magnetic trip device with a wide tripping threshold setting range, comprising a fixed magnetic circuit bearing an excitation coil and having a first and a second polar part located one in the extension of the other and separated by a fixed air-gap and a moving core assembly, slidingly mounted inside said fixed magnetic circuit and having a first core assembly part with a polar surface defining a first variable air-gap with said first polar part, the value of which varies with the movement of the moving core assembly.

A magnetic trip device of the kind mentioned is generally associated with a current breaking device, notably a circuit breaker protecting lines or equipment against short-circuit currents. The tripping threshold must be suited to the installation protected, and trip devices advantageously include adjustment of this threshold. State-of-the-art setting adjustments act either on the return force of the trip device moving assembly or on the length of the air-gap, but the adjustment possibilities are limited, and these adjustments are not linear. In some applications, the setting range must be large, as the threshold can vary from 1 to 5 or even more, in particular when protecting an electric motor is involved. State-of-the-art adjustment devices are unable to provide linearity over such a wide setting range and do not meet the present requirements.

The object of the invention is to achieve a magnetic trip device with a wide setting range appreciably linear over the whole setting range, while preserving the simplicity indispensable for satisfactory operation.

SUMMARY OF THE INVENTION

The magnetic trip device according to the invention is characterized in that said moving core assembly comprises a second part mechanically united to the first part, and magnetically insulated from the latter, that said second part defines with said second polar part a second variable air-gap, the attraction effects exerted on the moving core assembly by the magnetic fields generated by the coil in said first and second variable air-gaps being opposing, and that an adjustment device is arranged to fix the initial position of the moving core assembly and to adjust the tripping threshold appreciably linearly.

By using a moving core assembly in two parts hereafter called plunger cores generating opposing effects, the adjustment scope is greatly extended and meets the linearity requirement over the whole setting range. The two plunger cores are mechanically united but magnetically insulated from one another and they define a distribution of the magnetic flux generated by the coil, depending on the reluctance of the different paths, proportional to the respective values of the different air-gaps. The first plunger core acts in the tripping direction, whereas the second plunger core acts in the opposite direction, and the magnetic circuit of this second plunger core is arranged to be saturated before that of the first plunger core. The tripping threshold is modified by adjusting the initial position of the moving core assembly, a minimum threshold, for example three times the rated current, corresponding to a position of the moving core assembly in which only the first plunger core acting in the tripping direction is active. For a maximum tripping value, for example eleven times the rated current, the moving core assembly is disposed in such a way as to make both the plunger cores act, the action of the first core being preponderant, but strongly counteracted by the action of the second plunger core. According to one embodiment, the magnetic circuit comprises a tubular part on which the excitation coil is located, this tubular part being subdivided into two parts longitudinally separated by a fixed air-gap, so as to define two coaxial polar parts disposed one in the extension of the other. The first polar part has a smaller internal diameter than that of the second polar part, and the second plunger core is slidingly mounted inside this first polar part, whereas the first plunger core is slidingly mounted inside the second polar part of larger internal diameter. The flux distribution in the magnetic circuit will become more clearly apparent from the following description, but it can easily be understood that the presence of two active air-gaps associated with the two plunger cores contributes to achieving a wide setting range.

According to another embodiment, the magnetic circuit comprises two U-shaped parts disposed facing one another and cooperating with a blade core assembly.

BRIEF DESCRIPTION OF THE DRAWINGS

Other advantages and features will become more clearly apparent from the following description of two illustrative embodiments of the invention, given as non-restrictive examples only and represented in the accompanying drawings, in which.

DESCRIPTION OF THE PREFERRED EMBODIMENT

Figure 1:
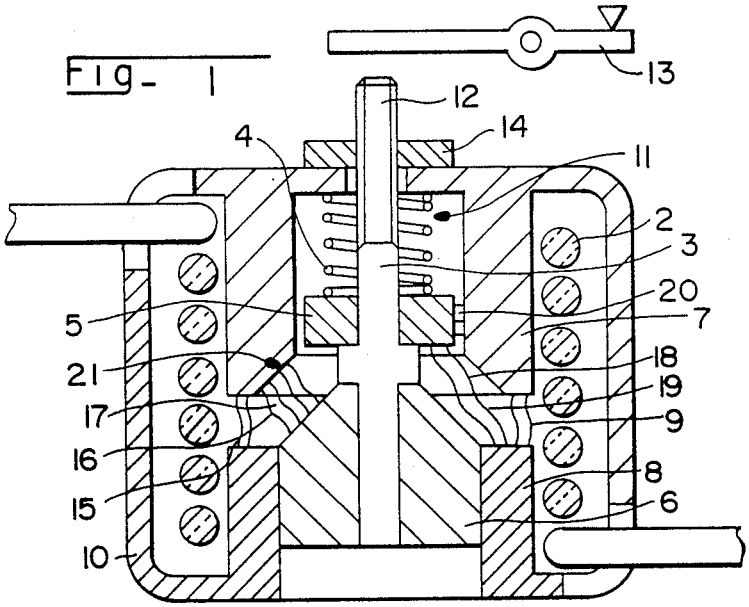
FIG. 1 is a schematic axial sectional view of a trip device according to the invention, represented in the make position, for an intermediate setting threshold.

In the figures, a magnetic trip device is formed by a fixed magnetic circuit 1, an excitation coil 2 and a movable assembly comprising two plunger cores 5, 6 fixed to a connecting rod 3 and biased by a return spring 4. The coil 2 is arranged around a first 7 and a second 8 polar part belonging to the magnetic circuit 1, the two polar parts 7, 8 being of coaxial tubular cylindrical shape and separated by a fixed axial air-gap 9. The two polar parts 7, 8 are connected by an external housing 10 of the magnetic circuit 1. The external diameters of the polar parts 7, 8 are identical, whereas the internal diameter of the first polar part 7 is smaller than that of the second polar part 8.

Inside the polar parts 7, 8 there is disposed a moving core 11, comprising a first plunger core 6 slidingly mounted with small clearance in the second polar part 8, and a second plunger core 5 slidingly mounted in the first polar part 7. The two plunger cores 5, 6 are secured to the sliding rod 3, whose end 12 arranged as a striker cooperates with a trip lever 13. The two plunger cores 5, 6 are longitudinally spaced in such a way as to create an air-gap magnetically insulating the two cores 5, 6, the rod 3 being for example made of non-magnetic material. The position of the moving core biased downwards in FIG. 1 by the return spring 4, is determined by a stop nut 14 borne by the rod 3, and cooperating with a fixed part, for example of the magnetic circuit 1. This stop can be achieved differently.

The force lines of the magnetic field, generated by the current flowing through the coil 2, are essentially distributed along three different paths. A first part 15 of the magnetic flux flows through the axial air-gap 9 between the two polar parts 7, 8 and closes via the housing 10. This magnetic flux 15 has no effect on the moving core assembly 11. A second active part 16 of the magnetic flux, represented in the left-hand part of the figures, flows through a first air-gap 17 between the first polar part 7 and the first plunger core 6, and closes via the second polar part 8 and the housing 10. This second magnetic flux 16 exerts an attractive force on the first plunger core 6, tending to move it upwards in FIG. 1 in the actuation direction of the trip lever 13, against the force of the return spring 4. A third part 18 of active magnetic flux, represented in the right-hand part of the figures, flows via a second air-gap 19, between the second plunger core 5 and the second polar part 8. This second magnetic flux 18 closes via the housing 10, the first polar part 7, and a fixed radial air-gap 20 defined by the clearance between the first polar part 7 and the second plunger core 5. The force exerted on the moving core assembly 11 is opposite to the tripping direction, and is opposed to that of the first plunger core 6.

It can easily be seen that the value of the first air-gap 17 and of the second air-gap 19 varies when the moving core assembly 11 moves, the first air-gap 17 decreasing when the moving core assembly 11 moves upwards, in the tripping direction and the second air-gap 19 increasing. The first air-gap 17 is defined by a frustum-shaped surface of the first plunger core 6, which cooperates with a bevel 21 of the first polar part 7, so as to increase the active air-gap surfaces.

Figure 2:
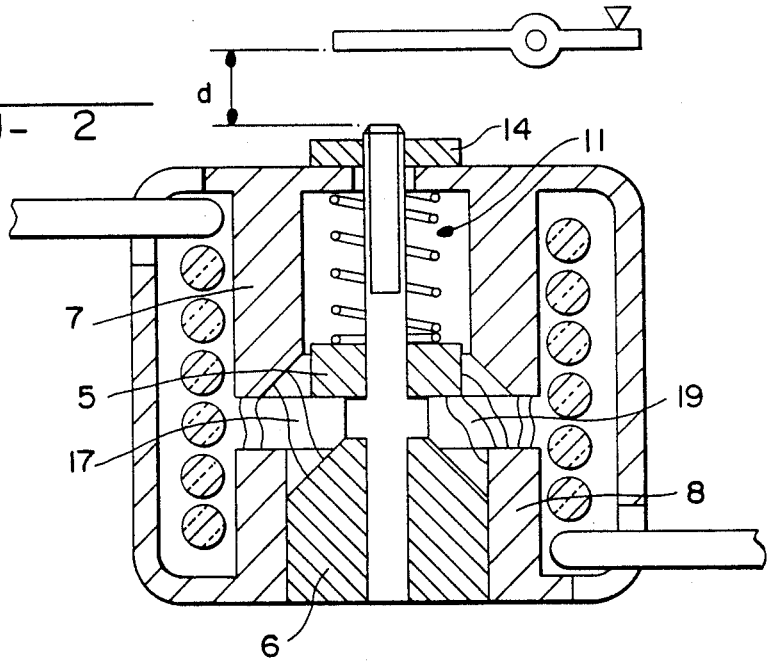
FIGS. 2 and 3 are similar views to that of FIG. 1 showing the trip device respectively for a maximum threshold and a minimum threshold setting.
Figure 3:
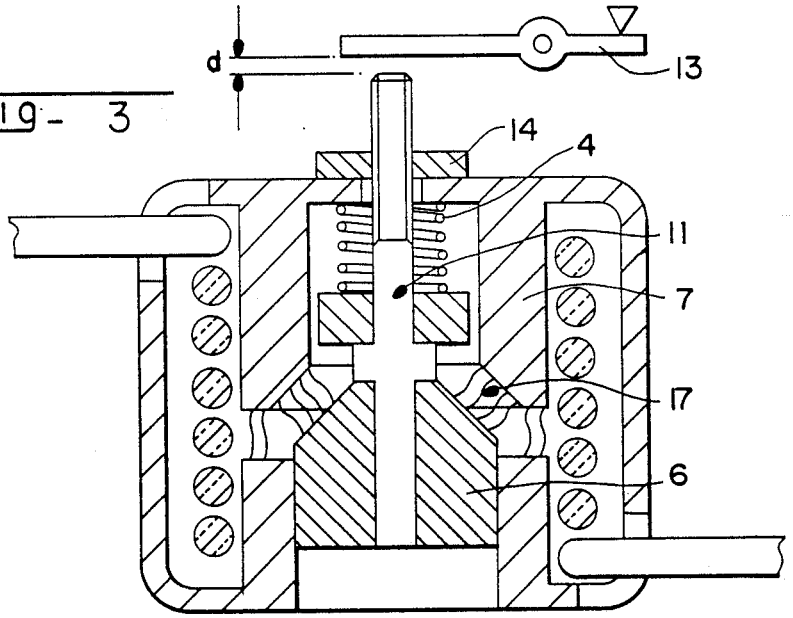
Figure 4:
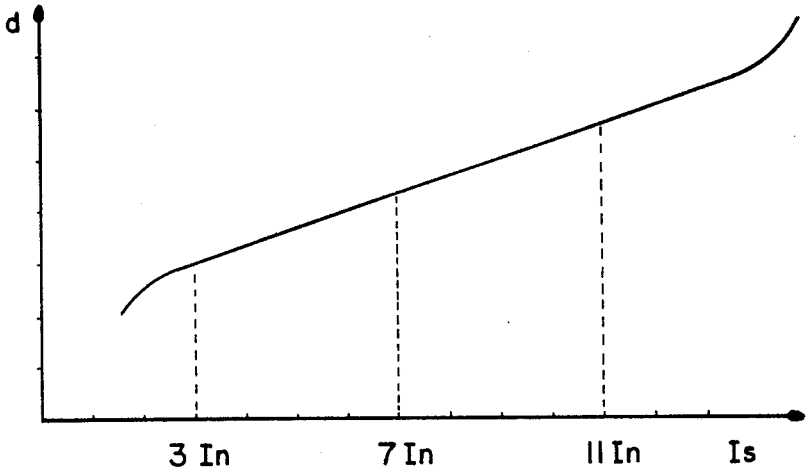
FIG. 4 represents the tripping threshold variation curve in terms of the initial position of the core.
Figure 5:
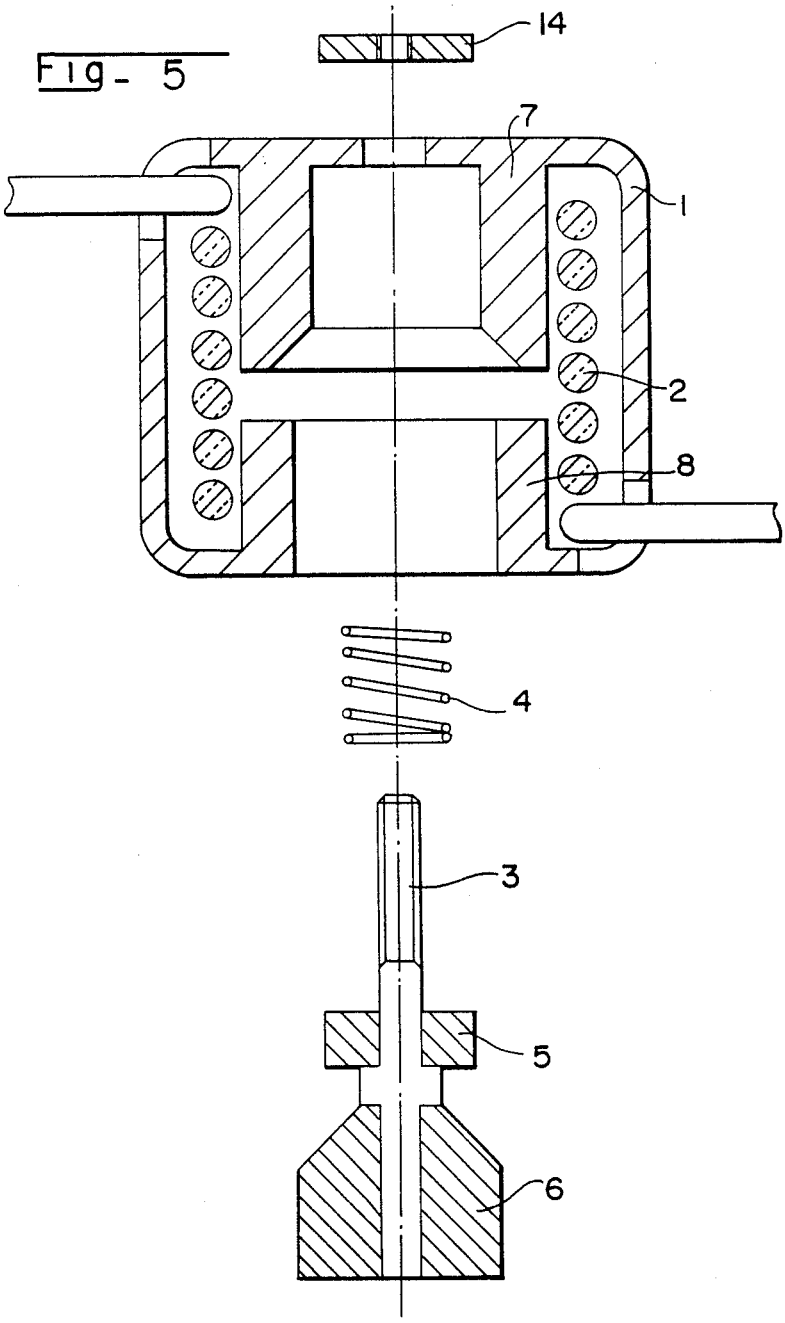
FIG. 5 is an exploded view of the trip device according to the invention.

The tripping threshold setting is adjusted as follows:

In FIG. 3 the position corresponding to a minimum tripping threshold setting is represented, for example three times the value of the rated current In (see FIG. 4). The setting nut 14 is screwed in such a manner as to move the moving assembly 11 to the up position, close to the trip lever 13, this position being defined by a minimum distance "d", for example between the end 12 of the sliding rod 3 and the trip lever 13. It can be seen in FIG. 3 that the first air-gap 17 is small, and that almost all the magnetic flux follows this path via the first polar part 7 and the first plunger core 6. The second plunger core 5 is far from the corresponding polar part 8 and magnetic leakage via this path is almost negligible. This results in a strong attractive force of the first plunger core 6, which is not counteracted by the opposing force generally generated by the second plunger core 5. The tripping threshold is low and essentially determined by the force of the return spring 4. FIG. 2 represents the setting position corresponding to the other limit value of the tripping threshold. The adjusting nut 14 has been unscrewed in FIG. 2 to allow downwards sliding of the moving assembly 11. In this initial position, the first air-gap 17 between the first polar part 7 and the first plunger core 6 is large. The attraction of the first plunger core 6 is nevertheless preponderant, but the tripping movement only takes place when the current flowing in the coil 2 exceeds a high threshold value, for example eleven times the rated current. The tripping effect is enhanced by the saturation of the force lines passing through the second polar part 8 and the second plunger core 5 of smaller cross-section than that of the first polar part 7 and of the first plunger core 6.

An intermediate position is represented in FIG. 1 corresponding for example to a tripping threshold of seven times the rated current value. The opposing effect of the second plunger core 5 is present but has been notably reduced compared to that corresponding to the position represented in FIG. 2. The combined action of the two plunger cores 5, 6 enables adjustment of the tripping threshold to be almost linear over a wide setting range sufficient for present-day magnetic trip devices, notably protecting electric motors. The magnetic trip device according to the invention is comparable to the usual structure of such trip devices and does not implement any fragile or imprecise setting part.

Figure 6:
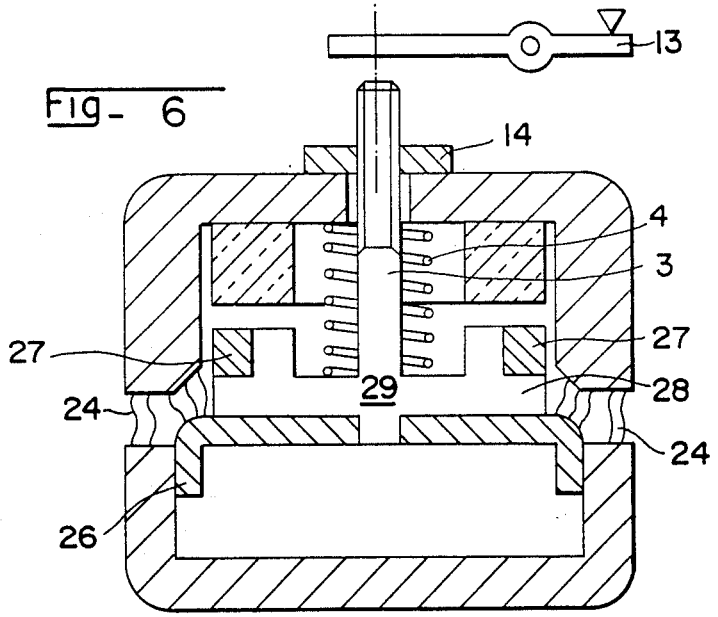
FIGS. 6 and 7 are similar views to FIGS. 2 and 3 illustrating an alternative embodiment.
Figure 7:
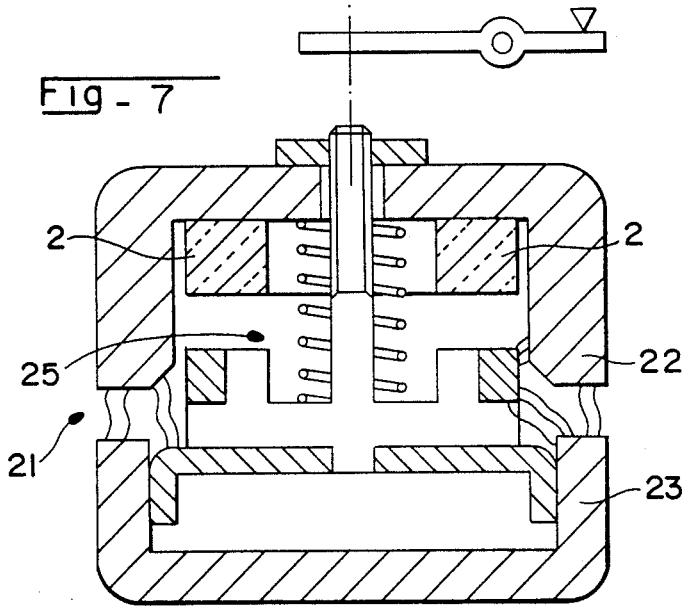

FIGS. 6 and 7 illustrate an alternative embodiment of the magnetic trip device according to the invention, wherein a fixed magnetic circuit 21 of a general rectangular shape is formed by a first U-shaped polar part 22 and a second U-shaped polar part 23, disposed facing one another and separated by two fixed air-gaps 24. The moving assembly 25 is located inside this magnetic circuit 21 and comprises on the one hand a blade 26, which moves aside when the moving assembly slides, and moves towards the first polar part 22, and on the other hand two plates 27 magnetically insulated from the blade 26 by an insulating part 28 and magnetically insulated from one another by a fixed air-gap 29, said ferromagnetic plates 27 being arranged facing the fixed air-gaps 24. The fixed magnetic circuit 21 bears the excitation conductor 2 and the spring 4 wound around the sliding rod 3 of the moving assembly 25 biases the latter to the down position in FIGS. 6 and 7.

Operation of this trip device is the same as that described above and it suffices to recall that in the minimum threshold setting position, represented in FIG. 6, the blade 26 has a small clearance with the first polar part 22, the opposing effect due to the plates 27 being nil. This results in a strong attractive force of the moving assembly 25 as soon as the conductor 2 is excited and a low tripping threshold. In the position illustrated in FIG. 7, the blade 26 is notably clear of the first polar part 22, whereas the plates 27 are moved closer to the second polar part 23 and are subjected to an opposing attractive force of the blade 26.

The invention is naturally in no way limited to the embodiment more particularly described but extends to alternative embodiments, notably where the rod 3 is made of magnetic material, but is of negligible cross-section, or where the coil 2 is located at a different place in the magnetic circuit, or where the rotational parts are replaced by sections, the air-gaps being located outside the coil.

I claim:

1. A magnetic trip device with a wide tripping threshold setting range, comprising a fixed magnetic circuit bearing an excitation coil and having a first and a second polar part located one in the extension of the other and separated by a fixed air-gap and a moving core assembly, slidingly mounted inside said fixed magnetic circuit and having a first part of the core assembly with a polar surface defining a first variable air-gap with said first polar part, the value of which varies with the movement of the moving core assembly, wherein said moving core assembly comprises a second part mechanically united to the first part, and magnetically insulated from the latter, said second part defines with said second polar part a second variable air-gap, the attraction effects exerted on the moving core assembly by the magnetic fields generated by the coil in said first and second variable air-gaps being opposing, and an adjustment device is arranged to fix the initial position of the moving core assembly and to adjust the tripping threshold appreciably linearly.

2. The magnetic trip device according to claim 1, wherein said first and second parts of the core assembly are plunger cores slidingly mounted inside the first and second tubular-shaped polar parts.

3. The magnetic trip device according to claim 1, wherein said first core assembly part is a blade disposed facing the air-gap surfaces of the first U-shaped polar part and said second part of the core assembly is formed by two plates cooperating with the second U-shaped polar part disposed facing the first polar part.

4. The magnetic trip device according to claim 1, wherein the cross-section of said first polar part and/or of said first core assembly part is greater than that of said second polar part and/or of said second core assembly part and said first polar part exerts on the moving core assembly an attractive force in the tripping direction.

5. The magnetic trip device according to claim 4, wherein the diameter of the second plunger core is smaller than that of the first plunger core, and the second plunger core is slidingly mounted in the first polar part.

6. The magnetic trip device according to claim 1, wherein the two plunger cores are fixed to a sliding rod extending in the axis of said polar parts, the two cores being separated longitudinally, and the first plunger core is located on the second polar part side whereas the second plunger core is located on the first polar part side.

7. The magnetic trip device according to claim 1, wherein in the minimum threshold setting position, the moving core assembly is in a position of minimum length of said first variable air-gap and of maximum length of said second variable air-gap, the opposing action of the second plunger core or of the plates being almost negligible.

8. The magnetic trip device according to claim 1, wherein a return spring biases the moving core assembly against a stop, defined by a tripping threshold adjusting nut.

9. The magnetic trip device according to claim 1, wherein the coil is located around said two polar parts connected by an external housing.

10. The magnetic trip device according to claim 3, wherein the coil is located on said U constituting the first polar part.

* * * * *